US009964254B1

(12) United States Patent
Hayes

(10) Patent No.: US 9,964,254 B1
(45) Date of Patent: May 8, 2018

(54) REST

(71) Applicant: Ardent Conceptual Design, Ltd., Sherman, TX (US)

(72) Inventor: Clint A. Hayes, Sherman, TX (US)

(73) Assignee: Ardent Conceptual Design, LTD., Sherman, TX (US)

( * ) Notice: Subject to any disclaimer, the term of this patent is extended or adjusted under 35 U.S.C. 154(b) by 0 days. days.

(21) Appl. No.: 14/165,260

(22) Filed: Jan. 27, 2014

Related U.S. Application Data

(60) Provisional application No. 61/756,769, filed on Jan. 25, 2013.

(51) Int. Cl.
*F16M 13/02* (2006.01)
*F41A 23/02* (2006.01)
*F41A 23/10* (2006.01)

(52) U.S. Cl.
CPC ..... *F16M 13/02* (2013.01); *F41A 23/02* (2013.01); *F41A 23/10* (2013.01)

(58) Field of Classification Search
CPC ..... F16M 13/02; F41A 23/02; F41A 23/10
USPC ..... 248/102, 118, 118.1, 121, 125.1, 346.2, 248/514, 558, 690; 42/94; 2/463, 413, 2/465, 98, 913; 441/108, 129–132; 5/420, 630, 631; 111/102, 118, 118.1, 111/121, 125.1, 346.2, 514, 558, 690
See application file for complete search history.

(56) References Cited

U.S. PATENT DOCUMENTS 960,129 A * 5/1910 Wilkinson ..... B63C 9/155 441/108
2,507,939 A 5/1950 Smith
2,566,838 A 9/1951 Hurt
3,513,491 A * 5/1970 Gordon ..... A47C 27/00 5/420
4,473,913 A * 10/1984 Ylvisaker ..... A47C 20/021 5/632
4,558,532 A * 12/1985 Wright ..... F41A 23/16 42/94
4,691,371 A 9/1987 Derby
4,730,801 A * 3/1988 Cloward ..... A61G 13/12 248/118
4,905,330 A * 3/1990 Jacobs ..... A47C 17/045 482/23
4,987,625 A * 1/1991 Edelson ..... A47C 20/026 5/420
5,054,142 A * 10/1991 Owens ..... A47C 17/04 5/633
5,086,529 A * 2/1992 DeGroot ..... A47C 27/001 5/710
5,149,033 A * 9/1992 Burzler ..... A61G 7/0755 248/118
5,279,310 A * 1/1994 Hsien ..... A61F 5/01 128/DIG. 20

(Continued)

*Primary Examiner* — Muhammad Ijaz

(57) ABSTRACT

A rest comprises a preformed support member and an adjustable base. The preformed support member has a right stabilizing compartment a left stabilizing compartment, and a recessed median trough positioned between the right stabilizing compartment and the left stabilizing compartment. The adjustable base includes at least one front base member and at least one rear base member, wherein the at least one front base member and the at least one rear base member are foldably fastened to the preformed support member on opposing sides thereof.

19 Claims, 3 Drawing Sheets

(56) References Cited

U.S. PATENT DOCUMENTS

| | | | | | |
|---|---|---|---|---|---|
| 5,332,185 | A * | 7/1994 | Walker, III | F41A 23/02 | 248/346.2 |
| 5,400,449 | A * | 3/1995 | Satto | A47C 20/021 | 5/631 |
| 5,987,675 | A * | 11/1999 | Kim | A47C 20/026 | 5/632 |
| 6,378,235 | B1 * | 4/2002 | Smith | F41A 23/02 | 42/94 |
| 7,007,328 | B1 * | 3/2006 | Bailey | A47C 9/027 | 5/632 |
| 7,020,918 | B1 * | 4/2006 | Tinsley | A47C 16/00 | 5/630 |
| 7,305,728 | B2 * | 12/2007 | Schlieps | A47C 9/027 | 5/655.9 |
| 7,634,829 | B1 * | 12/2009 | La Bar | A47C 20/026 | 5/632 |
| 7,661,163 | B1 * | 2/2010 | Gallaher | A47C 20/021 | 5/632 |
| 8,510,878 | B2 * | 8/2013 | Wang | A47G 27/0237 | 5/417 |
| 2012/0233772 | A1 * | 9/2012 | Wang | A47G 27/0237 | 5/417 |

* cited by examiner

REST

CLAIM OF PRIORITY

This Application claims priority to U.S. Provisional Application Ser. No. 61/756,769 filed on Jan. 25, 2013, entitled "Rifle Rest," which is incorporated herein by reference.

SUMMARY OF THE DISCLOSURE

The present disclosure relates generally to the field of rests, and more specifically to a firearm rest for providing stability and support while shooting a firearm under a variety of shooting conditions and surfaces.

BACKGROUND

Rifles and firearms may be fired in a variety of physical and environmental settings. Stability and support are beneficial when firing a rifle, in particular, for improved accuracy. Traditionally, sandbags have been used to support the proximal end of rifles to improve stability for the proximal end and scope mounted thereon. However, sandbags are not only heavy in weight, but one or more sandbags may be required to provide a desired height or physical configuration, which requires the hunter/shooter carry several sandbags, which can be heavy and bulky. What is needed in the art is an improved rest for use with firearms, photography equipment, etc.

SUMMARY

The present disclosure provides a rest for use in various configurations and with various surfaces and structures.

In one embodiment, a rest comprises a preformed support member and an adjustable base. The preformed support member, in this embodiment, has a right stabilizing compartment, a left stabilizing compartment, and a recessed median trough positioned between the right stabilizing compartment and the left stabilizing compartment. The adjustable base, in this embodiment, has at least one front base member and at least one rear base member, wherein the at least one front base member and the at least one rear base member are foldably fastened to the preformed support member on opposing sides thereof.

In another embodiment, a rest comprises a preformed support member having a width and thickness, the preformed support member having a right stabilizing compartment, a left stabilizing compartment and a recessed median trough positioned between the right stabilizing compartment and the left stabilizing compartment. The rest further includes, in this embodiment, an adjustable base, the adjustable base having at least one front base member and at least one rear base member, wherein the at least one front base member and the at least one rear base member are fastened beneath the preformed support member and configured to fold along an axis substantially perpendicular to the thickness of the preformed support member.

DETAILED DESCRIPTION

Figure 1:
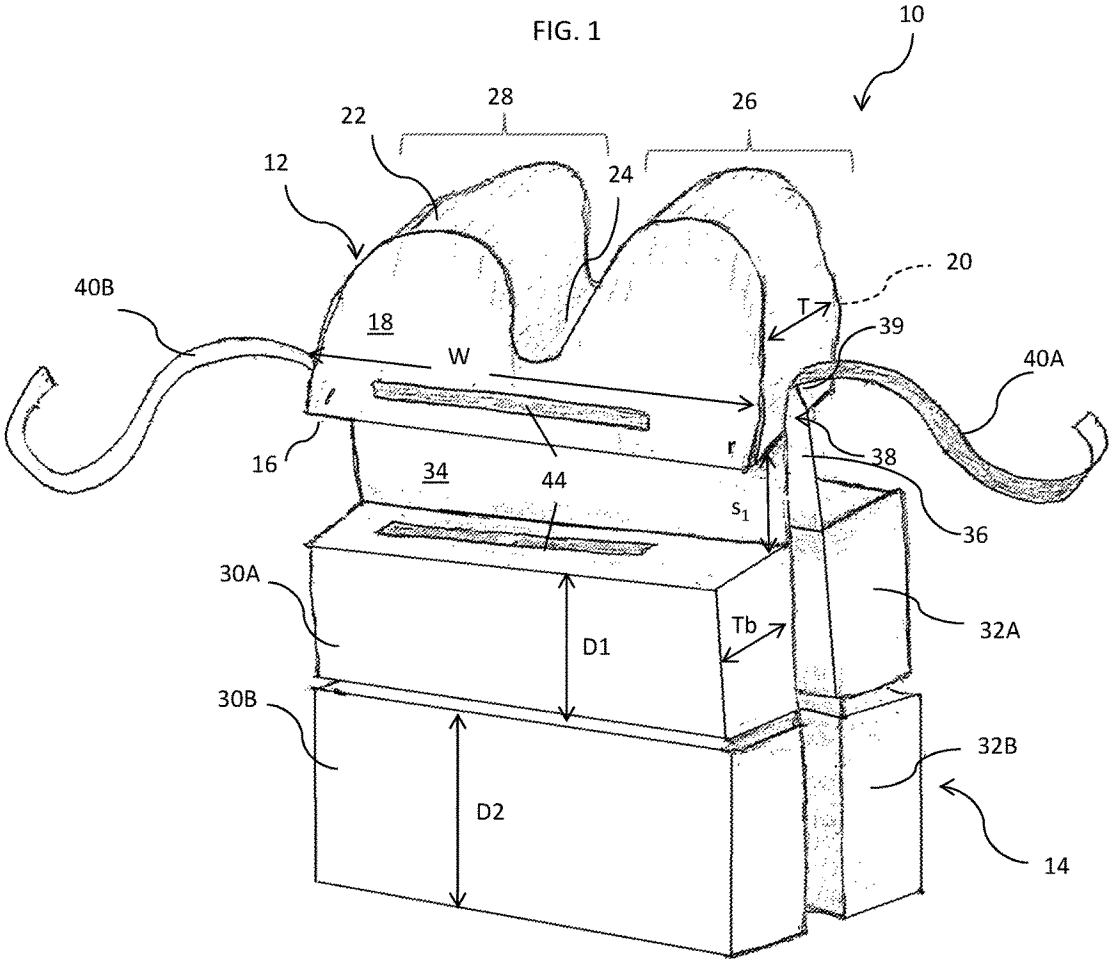
FIG. 1 is a perspective view of one embodiment of a rest according to the present disclosure.

Various rests for use with firearms such as rifles and photography equipment are available in the industry, including tripod mounted rests and sand bags. While the various rifle and firearm rests may be configured to support specific models of firearms and/or able to accommodate a variety of rifles, none of the available rests are configured to include a plurality of physical configurations for use on a plurality of surface types. For example, certain rifle rests may be configured for mounting atop a fence rail or post, but the same rifle rest may not then be easily configured for use lying on a relatively flat surface. Likewise, rests atop tripods may mount on various surfaces, but a certain amount of surface area is required to support the tripod, so a tripod supported rest cannot be mounted on a surface having a relatively thin width or small surface area. Also, traditional rests, such as sandbags are heavy and create bulk and weight during transport, in addition to difficulties in mounting the sandbag in a relatively stable position on or about various surfaces and physical configurations. Likewise, various rests may provide support and stability, but are not at an adequate height, nor can such rests be adjusted.

Described herein is a rest for providing stability and support while using hunting devices, photography equipment, magnifying devices, etc. In many instances, the rest may be used for shooting a firearm (e.g., rifle, handgun, etc.) during marksmanship or hunting under a variety of shooting conditions and surfaces. While the rest may be described in many instances as a rifle or firearm rest, those skilled in the art understand that such a reference is being used for ease of discussion, and that the rest could just as easily be used for supporting other devices, such as the brief list described above.

In accordance with one embodiment, the rest may be adjusted in height and in physical configuration such that the rest by be affixed atop a beam, such as a fence rail, may be hung from an elevated crossbar/beam, hung over an opening such as a window opening in a hunting blind, hung over a partially closed window of an automobile, may be configured to lie on a relatively flat surface, or many other situations. The rest not only stabilizes the firearm while taking aim, it also functions as a ballast to dampen perceived recoil while firing. The rest may be fabricated from PVC, Vinyl, leather and/or other flexible material combinations and have a plurality of compartments that are stitched together to form the whole, the compartments being flexible and filled with foam, particulate matter, or fluid, inter alia, of various densities or other suitable filler material. The compartments, in one embodiment, include one or more openings therein for adding removing one or more materials therefrom. For instance, certain embodiments exist wherein the rest is configured to be set up and taken down in the field. In this embodiment, the compartments would be configured to retain water, sand or other materials while in use. Accordingly, in certain embodiments the compartments are water tight, including any seams that may be used.

The present disclosure incorporates a recessed median trough into the support member into which the firearm may be rested. The present disclosure also incorporates a novel design and mechanism in which the configuration/conformation of the entire device can be easily changed from a configuration ideal for use while hanging from an elevated support (such as a tree branch, automobile door/window, sideview mirror, tailgate, deerstand window sill, fence wire, etc.) to a configuration ideal for use while resting on a relatively flat surface (such as a pickup hood, shooting bench, the ground, etc.) The unique configuration and construction of this rest enables its use from almost any firing position, such as hanging from the door, sideview mirror, tailgate, the window sill of a deerstand, from a gate or fence, or lying on a shooting bench, pickup hood, or on the ground. Additionally, the rifle rest according to the present disclosure can cradle and grasp the barrel of a firearm in a variety of angles and positions without the need for elaborate, time-consuming adjustments. The rest also incorporates a fastening strap, which in addition to fastening the rest onto various surfaces in various configurations, may also be used as a carrying handle. The fastening strap may be used to secure the rest onto various surfaces, and also may be used for hanging the rifle rest as described above.

Referring now to FIG. 1, there is shown a perspective view of a rifle rest 10 comprising one embodiment of the present disclosure. Rifle rest 10 comprises a preformed support member 12 coupled with an adjustable base 14. Preformed support member 12 comprises an enclosure having a width W and a thickness T and enclosed by a bottom surface 16, a front surface 18, a rear surface 20, and a curved top surface 22. The preformed support member 12 has a median trough 24 recessed near the center thereof, positioned between a right stabilizing compartment 26 and a left stabilizing compartment 28. The top surface 22, in this embodiment, spans from a right end, r, of bottom surface 16 across the right stabilizing compartment 26, the median trough 24, and the left stabilizing compartment 28 and ends at a left end, l, of the bottom surface 16.

The preformed support member 12 may be filled with a flexible filler material such that the bottom surface 16, curved top surface 22, front surface 18, and rear surface 20 are pliable and provide a cushion for objects placed thereon. The distal end of a rifle may be placed onto the curved top surface 22 in the median trough 24 and cradled therein. In addition to the cradle provided by the median trough 24, support on both sides by the right stabilizing compartment 26 and left stabilizing compartment 28 provide additional stability and support to the rifle. Similarly, a user firing a handgun may likewise rest the hand and proximal end of the handgun or similar weapon into the median trough 24. Likewise, the rifle rest 10 may also be used for shotguns and other barreled firearms in the same manner as described in conjunction with a rifle, and other equipment such as binoculars, scopes, among others. The filler may be a material such as a foam filler, dirt/sand/soil and other particulate matter, fluid, or other suitable materials used for filler that provide cushion yet maintain a certain stability and support. For example, a foam filler such as the material used in various gym mats and safety pads may be used.

The bottom surface 16, front surface 18, rear surface 20, and curved top surface 22 may all be fabricated using a same material such as PVC, vinyl, leather and/or other flexible material combinations. Further, a non-skid material may be used for substantially all of the surfaces of preformed support member 12 and in some embodiments on right stabilizing compartment 26 and left stabilizing compartment 28 and the surfaces (bottom surface 16, front surface 18, rear surface 20, and curved top surface 22) of the rifle rest 10 where friction applied to the firearm placed thereon may provide additional stability and support for the firearm under various conditions and configurations.

The adjustable base 14 may comprise one or more front base members 30 and one or more rear base members 32. As shown in FIG. 1, the adjustable base 14 includes a first front base member 30A, a second front base member 30B, a first rear base member 32A and a second rear base member 32B. In the particular embodiment of FIG. 1, the one or more front base members 30 and the one or more rear base members 32 (e.g., including the first front base member 30A, the second front base member 30B, the first rear base member 32A and the second rear base member 32B) are coupled beneath the preformed support member 12 and are configured to fold along an axis substantially perpendicular to thickness T of the preformed support member 12. The front base members 30 and rear base members 32 may be characterized by a thickness Tb, which may be substantially similar to the Thickness T of the preformed support member 12, but may in some embodiments, be either thicker or thinner. Moreover, each of the front base members 30 and rear base members 32 may have the same thickness Tb in certain embodiments, and may have various different thicknesses Tb in certain other embodiments.

The adjustable base 14 may comprise similar filler materials as those used for the preformed support member 12. In certain embodiments, however, the material may be more dense or heavier in weight such that adjustable base 14 will have more weight than the preformed support member 12. The greater weight of adjustable base 14 is configured to shift the center of gravity of the rifle rest 10 downward, providing additional stability and security to the rifle rest 10 when positioned in a configuration where the adjustable base 14 hangs downward as is shown in FIG. 1, such as if rifle rest 10 were placed over a surface such as, for example, a beam, window sill, a fence, and the like.

In the embodiment shown, the first front base member 30A is foldably coupled beneath the preformed support member 12 via an extension 34. First rear support member 32A is coupled similarly beneath preformed support member 12 by a similar extension 36. The extensions 34, 36, in one embodiment, are specifically sized. For example, in one embodiment the extensions 34, 36 have a size ($s_1$) equal to about ½ the value of the Thickness T. Second front base member 30B and second rear base member 32B may comprise similar extensions for coupled onto first front base member 30A and first rear base member 32A. Additional front and rear base members may be incorporated into the rifle rest of the present disclosure for additional flexibility in configuration and support.

In some embodiments, the bottom surface 16 may have a channel 38 incorporated near the center thereof extending the width W of the preformed support member 12. Channel 38 may provide additional stability to rifle rest 10 by enabling the bottom surface 16 to surround and engage a surface onto which the rifle rest 10 is placed. Channel 38 may include a hinge 39 whereby extensions 34 and 36 may be coupled thereto. Coupling the adjustable base 14 to the preformed support member 12 may provide additional ease of movement and adjustability. The hinge 39 not only provides a coupling for the extensions 34 and 36, but also provide a counterweight to the weight from the enclosure of the preformed support member 12.

The rifle rest 10 further includes a fastening strap 40 having a first end 40A and a second end 40B, each of which are coupled at opposing ends of the preformed support member 12. The fastening strap 40 includes a hook fastener which engages a loop fastener such that the rifle rest may be secured onto a surface for additional stability. Further the fastening strap may be configured for hanging the rifle rest 10 from an elevated surface or beam-like structure whereby the rifle rest 10 is hanging beneath the elevated surface.

The front base members 30 and rear base members 32 are configured to fold laterally along an axis which is perpendicular to thickness T of the preformed support member 12, which enables the adjustable base 14 to be configured and positioned in a variety of configurations. Hook and loop fasteners 44 are positioned on the front surface 18 and rear surface 20 for receiving and engaging hook and loop fasteners 44 on first front base member 30A and similar first rear base member 32A in order to maintain a desired position once positioned.

Figure 2:
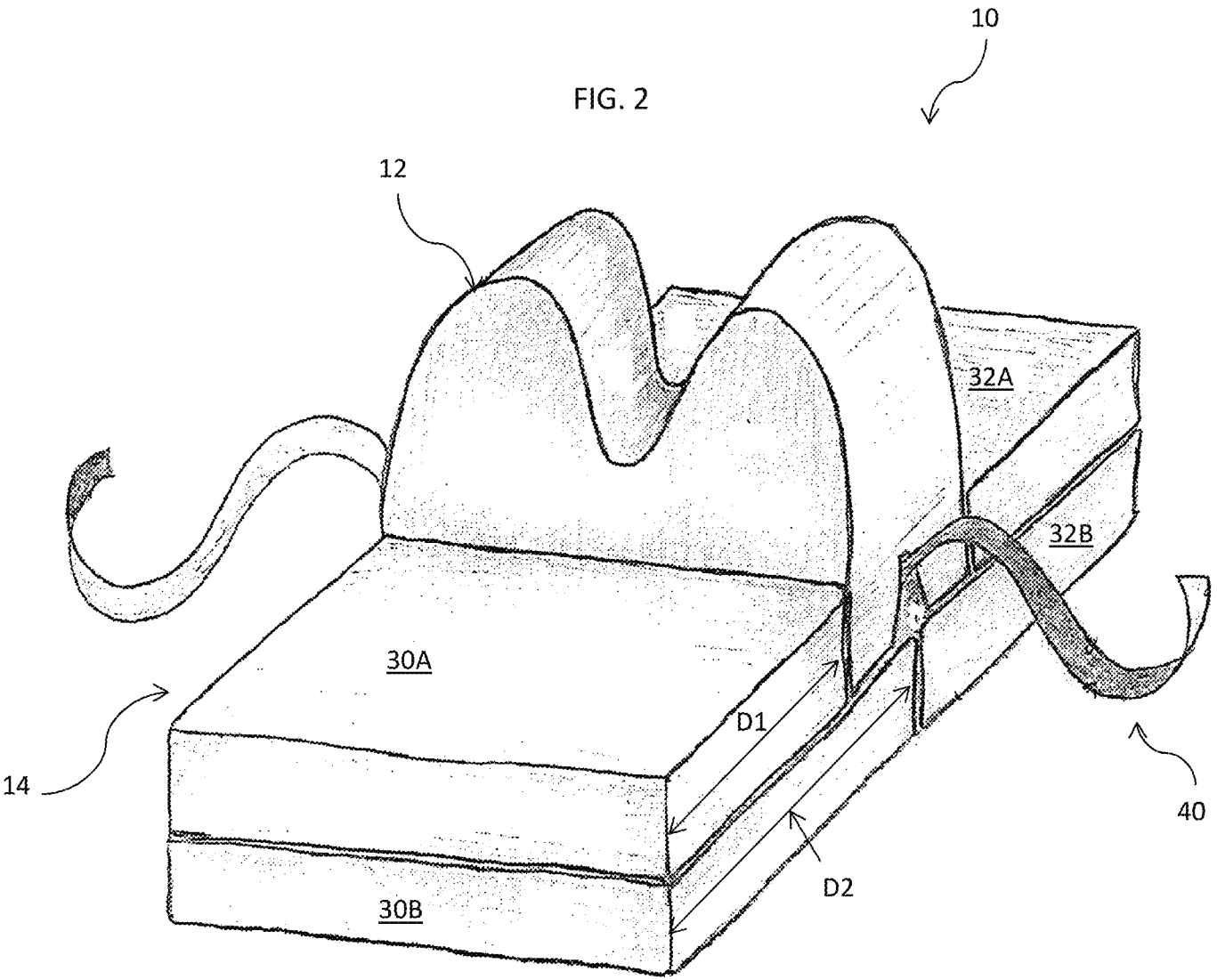
FIG. 2 is another view of the rest shown in an alternate configuration.

Referring now to FIG. 2, there is shown the rifle rest 10 in a "bench" position such as may be used on a flat surface such as a shooting bench, vehicle surface, or the ground. The rifle rest 10 is configured having the adjustable base 14 folded wherein the first front base member 30A abuts the front surface 18, with the second front base member 30B folded underneath. Likewise, first rear base member 32A is adjacent the rear surface 20 and second rear base member 32B is folded underneath. As shown, the depth D2 of the second front base member 30B is greater than depth D1 of the first front base member 30A such that the second front base member 30B folds for positioning underneath both the first front base member 30A and extend beneath preformed support member 12. The various hook and loop fasteners work together to augment the stability of the rifle rest 10 in the "bench" position.

Figure 3:
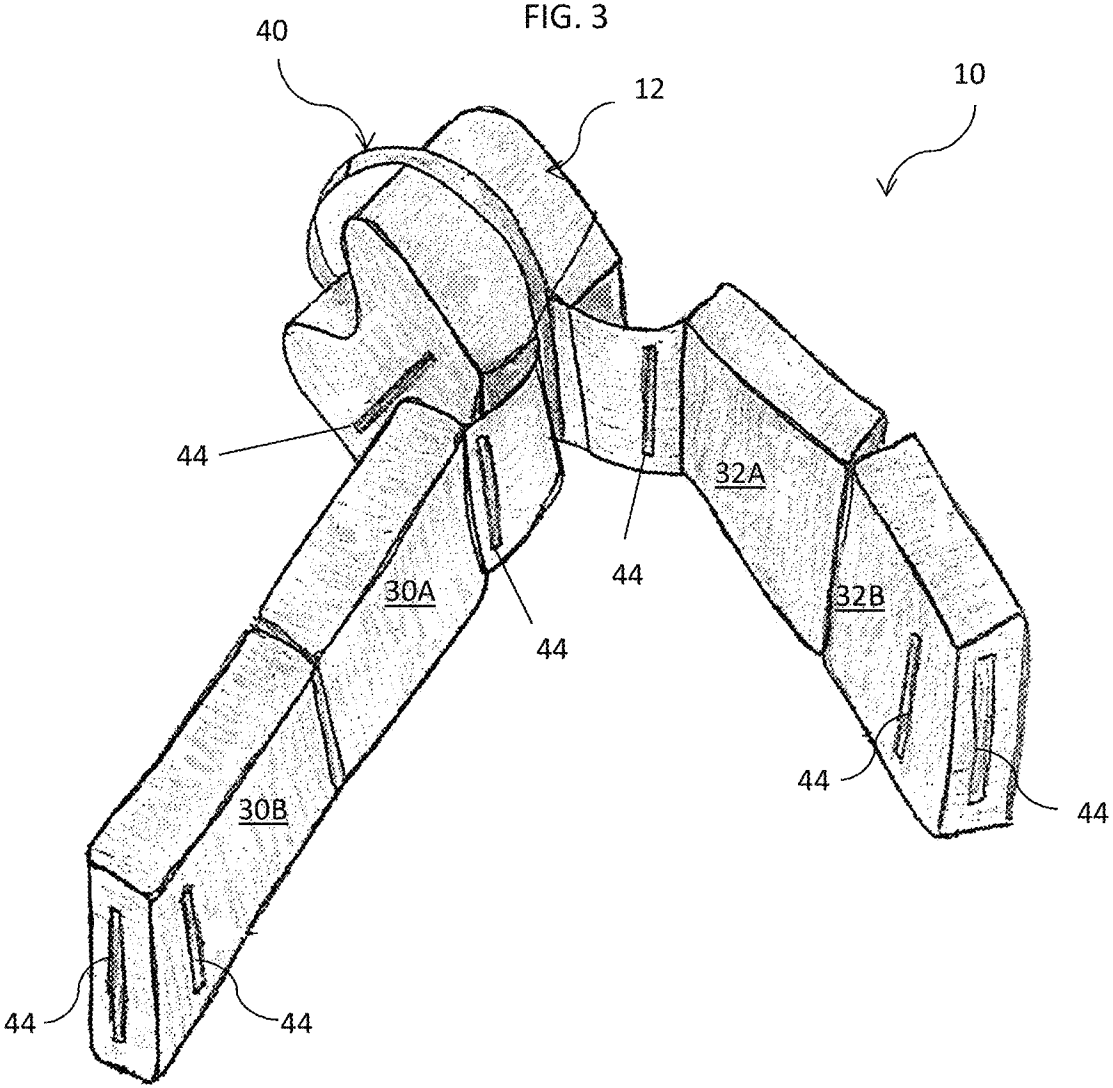
FIG. 3 is yet another view of the rest shown in another configuration.

Hook and loop fasteners 44, shown in FIGS. 1 and 3, are positioned on the front surface 16, a proximal end of front base member 30A relative to the preformed support member 12, second front base member 30B and the extension 34 such that the second front base member 30A folds beneath first front base member 30A and may secure directly beneath the preformed support member 12. The first rear base member 32A and second rear base member 32B are configured in a similar fashion with similar features. By folding the second front base member 30B and second rear base member 32B underneath the preformed support member 12, the rifle rest 10 may be positioned on a relatively flat surface for providing stability and further providing a certain amount of height, higher than if adjustable base 14 included only one front and rear base member. Further, first front base member 30A, and similarly first rear base member 32A may provide additional cushioning and stability for a shooter resting, for example, an elbow on the adjustable base 14. Similarly, if the fastening strap 40 is configured such that the rifle rest 10 is hanging beneath a beam or similar surface, stability may be gained by the ability to rest on the adjustable base 14.

Referring now to FIG. 3, there is shown a perspective bottom view of rifle rest 10. The hook and loop fasteners 44 are shown positioned on ends of the second front base member 30B and second rear base member 32B such that the ends thereof may fasten together when the adjustable base 14 is folded in a configuration such as shown in FIG. 2. Likewise, there are hook and loop fasteners on the extensions 34 and 36 which engage fasteners on a bottom side of each second front base member 30B and second rear base member 32B for additional stability and security once the adjustable base 14 is folded into a desired position.

While not shown, rifle rest 10 may incorporate additional features to adjustable base 14 such as additional front base members 30 and additional rear base members 32. The front base members 30 may secure to each other via hinges, hook and loop closures, or extension flaps, such that a subsequent base member would be configured for folding into various additional configurations. The rear base members 32 may be configured similarly.

Those skilled in the art to which this disclosure relates will appreciate that other and further additions, deletions, substitutions and modifications may be made to the described embodiments.

The invention claimed is:

1. A rest, comprising:

a preformed support member, the preformed support member having a right stabilizing compartment, a left stabilizing compartment, and a recessed median trough positioned between the right stabilizing compartment and the left stabilizing compartment, the right and left stabilizing compartments substantially fixed about the recessed median trough with respect to one another; and an adjustable base, the adjustable base having a first front base member foldably fastened directly to the preformed support member, a second front base member foldably fastened directly to the first front base member, and an opposing first rear base member foldably fastened directly to the preformed support member and a second rear base member foldably fastened directly to the first rear base member, such that the first and second front base members and first and second rear base members allow the rest to be reconfigured between a hanging position and a bench position while the recessed median trough is in a substantially upward and exposed position.

2. The rest according to claim 1, further comprising a fastening strap.

3. The rest according to claim 2, wherein the fastening strap comprises a first side and a second side, wherein the first side and second side fasten together via hook and loop fasteners.

4. The rest according to claim 1, wherein the recessed median trough comprises a non-skid material.

5. The rest according to claim 1, wherein the first front base member and the first rear base member are each fastened near a bottom surface of said preformed support member by one or more hinges.

6. The rest according to claim 1, wherein the first and second front base members are foldably coupled to each other with one or more hinges and wherein the first and second rear base members are foldably coupled to each other with one or more hinges.

7. The rest according to claim 1, wherein the first and second front base members are foldably coupled to each other with hook and loop fasteners, and the first and second rear base members are foldably coupled to each other with hook and loop fasteners.

8. The rest according to claim 1, wherein the preformed support member is filled with a filler selected from the group consisting of foam, particulate matter, and fluid.

9. The rest according to claim 1, wherein the adjustable base member is filled with a filler of selected from the group consisting of foam, particulate matter, and fluid.

10. The rest according to claim 1, wherein the first front base member and the first rear base member are configured to be held in position against the preformed support member by hook and loop fasteners.

11. The rest according to claim 1, wherein a depth of the second front base member is greater than a depth of the first front base member, and wherein a depth of second rear base member is greater than a depth of the first rear base member.

12. The rest according to claim 11, wherein the depth of the second front base member is greater than the depth of the first front base member by about ½ the thickness (T) of the preformed support member, and the depth of the second rear base member is greater than the depth of the first rear base member by about ½ the thickness (T) of the preformed support member.

13. The rest according to claim 1, wherein each of the first front base member, second front base member, opposing first rear base member and second rear base member fold about axes that are substantially perpendicular to a thickness (T) of the preformed support member.

14. A rest, comprising:

a preformed support member having a width and thickness (T), the preformed support member having a right stabilizing compartment, a left stabilizing compartment and a recessed median trough positioned between the right stabilizing compartment and the left stabilizing compartment, the right and left stabilizing compartments substantially fixed about the recessed median trough with respect to one another; and an adjustable base, the adjustable base having a first front base member foldably fastened directly to the preformed support member along a first axis substantially perpendicular to the thickness of the preformed support member, a second front base member foldably fastened directly to the first front base member, and an opposing first rear base member foldably fastened directly to the preformed support member along a second axis substantially perpendicular to the thickness of the preformed support member and a second rear base member foldably fastened directly to the first rear base member, such that the first and second front base members and first and second rear base members allow the rest to be reconfigured between a hanging position and a bench position while the recessed median trough is in a substantially upward and exposed position.

15. The rest according to claim 14, further comprising a fastening strap coupled onto the preformed support member.

16. The rest according to claim 14, wherein the preformed support member comprises a bottom surface, said bottom surface having a channel extending a length substantially similar to the width of the preformed support member.

17. The rest according to claim 16, wherein the channel includes a hinge supported therein, said hinge for receiving said first front base member and said first rear base member and coupling therewith.

18. The rest according to claim 14, wherein a depth of the second front base member is greater than a depth of the first front base member, and wherein a depth of second rear base member is greater than a depth of the first rear base member.

19. The rest according to claim 18, wherein the depth of the second front base member is greater than the depth of the first front base member by about ½ the thickness (T) of the preformed support member, and the depth of the second rear base member is greater than the depth of the first rear base member by about ½ the thickness (T) of the preformed support member.

* * * * *